United States Patent [19]

Rosso

[11] Patent Number: 4,872,774

[45] Date of Patent: Oct. 10, 1989

[54] INSTRUMENT FOR WRITING AND DRAWING

[75] Inventor: Walter Rosso, Turin, Italy

[73] Assignee: R.P.R. Righella di W. Rosso & C. S.a.s., Turin, Italy

[21] Appl. No.: 190,181

[22] Filed: May 4, 1988

[30] Foreign Application Priority Data

Jan. 13, 1988 [IT] Italy ..... 52821/88[U]

[51] Int. Cl.[4] ..... B43K 27/00; B43K 27/12

[52] U.S. Cl. ..... 401/29; 401/31; 401/34; 401/99; 401/209

[58] Field of Search ..... 401/29, 30, 31, 34, 401/99, 209

[56] References Cited

U.S. PATENT DOCUMENTS

| | | | |
|---|---|---|---|
| 1,153,807 | 9/1915 | MacPherson | 401/34 |
| 1,953,911 | 4/1934 | Parkin | 401/30 |
| 1,977,527 | 10/1934 | Pohee | 401/34 X |
| 2,113,861 | 4/1938 | Segal | 401/30 |
| 2,370,414 | 2/1945 | Ostrander | 401/34 X |

*Primary Examiner*—Steven A. Bratlie

*Attorney, Agent, or Firm*—Sughrue, Mion, Zinn, Macpeak & Seas

[57] ABSTRACT

A writing and drawing instrument comprises a main body of elongate shape having a first and a second writing end, a first and a second auxiliary body of elongate shape each of which is provided at its respective ends with a writing element, each of these bodies being mounted to rotate about an axis transverse to the main body in order to allow the alternative positioning of one of the two writing elements at one of the writing ends of the main body, each of the auxiliary bodies being able to slide longitudinally with respect to the main body between a first position in which the writing element positioned at the writing end is covered by the main body and a second position in which the writing element projects externally from the main body thereby allowing writing.

2 Claims, 1 Drawing Sheet

INSTRUMENT FOR WRITING AND DRAWING

DESCRIPTION

The present invention relates to an instrument for writing and drawing of the type comprising a plurality of writing elements, possibly containing different coloured inks.

The object of the invention is to provide a writing instrument which has the advantages of easy use and structural simplicity.

The invention relates in particular to a writing and drawing instrument characterized in that it comprises a main body of elongate shape having a first and a second writing end, a first and a second auxiliary body of elongate shape each of which is provided at its respective ends with a writing element, each of these bodies being mounted to rotate about an axis transverse to the main body in order to allow the alternative positioning of one of the two writing elements at one of the writing ends of the main body, each of the auxiliary bodies being able to slide longitudinally with respect to the main body between and writing element positioned by the main body and a second position in which the writing element projects externally from the main body thereby allowing writing.

As a result of the above features, the writing instrument may be provided with four writing elements, advantageously of different colours, each of which may be brought into the writing position in a particularly simple manner by a simple operation of rotation of one of the two auxiliary bodies and its horizontal translation and may then be returned into a position protected by the main body.

Further advantages and features of the instrument of the invention will be illustrated in the following detailed description, provided purely by way of non-limiting example, with reference to the attached drawings, in which.

Figure 2:
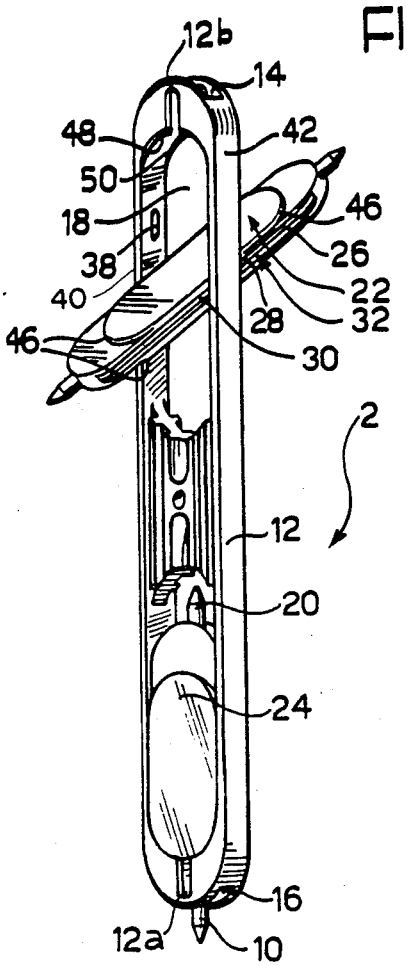
FIG. 2 is a perspective view of the instrument of FIG. 1.

With reference to the drawings, a writing and drawing instrument is indicated overall by 2, which instrument has the form, in the embodiment preferred at present, of a biro provided with four writing nibs 4, 6, 8 and 10 preferably containing different coloured inks.

The writing instrument comprises a main elongnate body 12 of plastic material having two writing ends 12*a* and 12*b* which may be held close to either end by the user.

The main body 12 has, at each writing end, an aperture 14 or 16 through which one of the writing nibs may be projected externally from the body.

The main body contains two eye-shaped slots 18, 20 in which there is rotatably mounted an auxiliary body 22, 24 in which the writing nibs forming part of a respective refill are inserted.

In the following description, reference is made to only one of the auxiliary bodies since both preferably have an identical configuration and the writing instrument substantially has a symmetrical configuration with respect to a transverse median plane.

Each auxiliary body has longitudinal side walls, provided with a groove 26 having in its median zone a shoulder 28 and defining two abutment surfaces 30 and 32 acting as ramp means which will be described below. The surface of the shoulder 28 has, at the point of the transverse median axis of the auxiliary body, a recess 34 in which a projection 36 acting as a hinge pin is engaged, the projection being borne by the inner surface of each side wall 40, 42 of the main body containing the slot 18 as a result of which the auxiliary body is articulated in a rotary manner with respect to the main body.

The inner surface of each wall 40, 42 has a projection 38, 44 which engages as a cursor in the groove of the side walls of the auxiliary body and acts both as a stop member to prevent the undesired rotation of the auxiliary body and as an actuator cooperating with the abutment surfaces 32 or alternatively 30 to allow, in the manner described below in more detail, the axial translation of each auxiliary body.

Each auxiliary body also has on its two base faces a stepped surface 46 acting as a catch with a shape complementary to each wall 48 and 50 which bounds the slot 18 and which forms the shape of the aperture 14.

Figure 1:
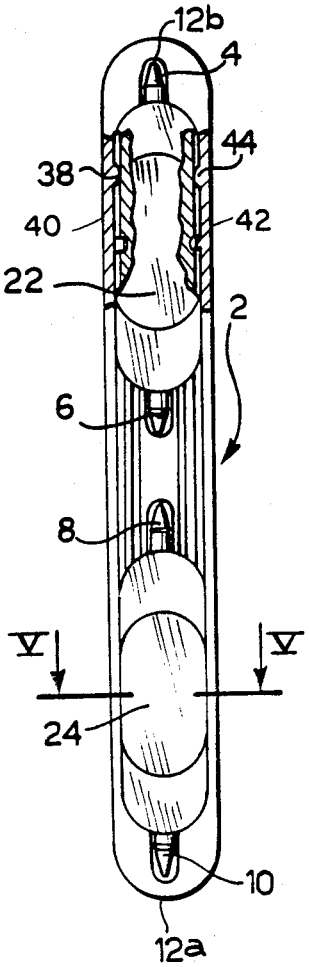
FIG. 1 is a front view, partly in section, of an instrument of the invention.
Figure 4:
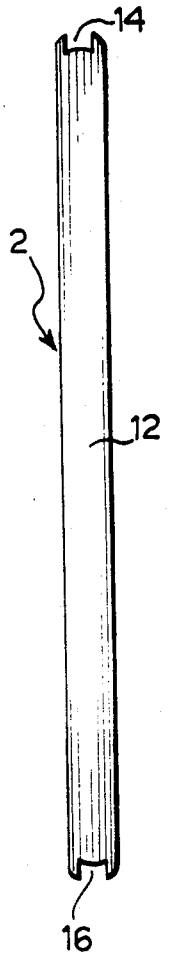
FIGS. 3 and 4 are respective plan and lateral views of the instrument of FIG. 1.
Figure 3:
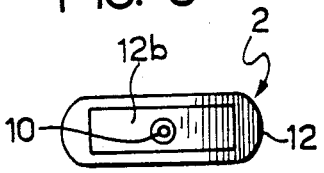
Figure 5:
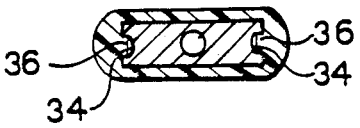
FIG. 5 is a cross-section along the line V—V of FIG. 1.

In the configuration shown in FIG. 1, the writing nibs 4, 6, 8 and 10 are completely enclosed in the profile of the main body as a result of which the writing instrument may be handled with no risk of soiling to a user. In order to use the instrument the user simply exerts pressure on one of the auxiliary bodies to cause its axial translation until the corresponding nib projects beyond the profile of the main body. After the pressure has been exerted, each projection 38, 44 causes, by cooperation with the abutment surface 32 or 30, the disengagement of the pins 36 and allows the axial translation of the auxiliary body from its respective housing 34 until the stepped surface 46 reaches a position abutting against the end walls 48 and 50. To use a different writing nib, for example of different colour, the auxiliary body has to be rotated through 180° from the rest position of FIG. 1 by a pressure which causes the snap disengagement of the projections 38 and 44 of the respective grooves of the auxiliary body and thus bringing the writing element into a writing positin by the axial translation of the auxiliary body.

As a result of its specific features, the writing instrument may also be used as a compass to draw circular arcs by disposing both auxiliary bodies in an angled position with respect to the main body.

The substance of the present invention naturally extends to modes which achieve similar utility and use the same inventive concept.

I claim:

1. A writing and drawing instrument comprising a main body of elongate shape having an elongate axis and a first and a second writing end, first and second auxiliary bodies each having an elongate shape and being provided at its respective ends with a writing element, each of said auxiliary bodies being mounted to rotate about an axis transverse to said elongate axis in order to allow the alternative positioning of one of the two writing elements at one of the writing ends of the main body, each of the auxiliary bodies being able to slide longitudinally with respect to the main body between a first position in which the writing element positioned at the writing end is covered by the main body and a second position in which the writing element projects externally from the main body thereby allowing writing, the main body having two slots in which the respective auxiliary body is slidably and rotatably mounted, each auxiliary body being provided with grooved lateral surfaces cooperating with stop means designed to prevent the undesired rotation of the auxiliary body with respect to the main body, and each auxiliary body having hinge means cooperating with the main body and ramp means able to cooperate with the stop means for causing resilient lateral deformation of the main body thereby disengaging the hinge means to allow and guide the axial translation of the auxiliary body following the disengagement of the hinge means.

2. An instrument as claimed in claim 1, wherein each auxiliary body has catch means which may cooperate with the end walls of each slot designed to prevent the auxiliary body from moving further away from the main body than the said second position.

* * * * *